US008727717B2

(12) United States Patent
Hsu et al.

(10) Patent No.: US 8,727,717 B2
(45) Date of Patent: May 20, 2014

(54) SERIAL FAN MODULE AND FRAME STRUCTURE THEREOF

(75) Inventors: Chia-Ming Hsu, Taoyuan Hsien (TW); Shun-Chen Chang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 1037 days.

(21) Appl. No.: 12/109,922

(22) Filed: Apr. 25, 2008

(65) Prior Publication Data

US 2009/0060732 A1 Mar. 5, 2009

(30) Foreign Application Priority Data

Aug. 31, 2007 (TW) ..... 96132412 A

(51) Int. Cl.
*F04D 29/54* (2006.01)

(52) U.S. Cl.
USPC ..... 415/199.5; 416/125

(58) Field of Classification Search
USPC ..... 415/198.1, 199.4, 199.5; 416/120, 124, 416/125, 198 R, 102
See application file for complete search history.

(56) References Cited

U.S. PATENT DOCUMENTS 5,577,888 A * 11/1996 Capdevila et al. ..... 415/210.1
6,648,602 B2 * 11/2003 Horng et al. ..... 416/203
6,663,342 B2 * 12/2003 Huang et al. ..... 415/121.2
7,238,004 B2 * 7/2007 Lin et al. ..... 415/199.4
7,275,911 B2 * 10/2007 Lee et al. ..... 415/211.2
8,029,236 B2 * 10/2011 Chang et al. ..... 415/199.5
2002/0094271 A1 7/2002 Yeuan
2005/0106026 A1 * 5/2005 Oosawa et al. ..... 416/198 R
2006/0045736 A1 * 3/2006 Lee et al. ..... 415/220

FOREIGN PATENT DOCUMENTS

CN 2679401 Y 2/2005
CN 1932303 A 3/2005
TW 569663 1/2004
TW M292888 6/2006

* cited by examiner

*Primary Examiner* — Edward Look
*Assistant Examiner* — Liam McDowell
(74) *Attorney, Agent, or Firm* — Muncy, Geissler, Olds & Lowe, P.C.

(57) ABSTRACT

A serial fan module includes a first fan, a second fan and a plurality of guide elements. The first fan has a first frame body and a first impeller disposed within the first frame body. The second fan has a second frame body and a second impeller disposed within the second frame body. The guide elements are disposed between the first impeller and the second impeller, wherein the guide elements guide airflow from the first fan to the second fan. Each of the guide elements has an axial extended part and an inclined part and the inclined part meets the axial extended part at a camber angle. Each of the inclined part has an inner edge toward the first impeller and each of the axial extended part has an outer edge toward the second impeller.

15 Claims, 9 Drawing Sheets

SERIAL FAN MODULE AND FRAME STRUCTURE THEREOF

BACKGROUND OF THE INVENTION

1. Field of the Invention

The present invention relates to a serial fan module and a frame structure thereof, and more particularly to a serial fan module and frame structure thereof capable of increasing static pressure of the airflow at the outlet, reducing noise and improving unstable flow field.

2. Description of the Related Art

As efficacy of electronic devices continue to increase, heat dissipating devices and heat dissipating systems are playing more critical roles within the electronic devices. Poor heat dissipation can lead to equipment damage or failure.

In particular, heat dissipating devices are playing a greater role for microelectronic elements and devices (e.g. integrated circuit, IC). Due to increased integration and advancement of packaging technology, integrated circuit area is increasingly being reduced and heat per unit area is thus increasingly being increased. Thus, high efficacy heat dissipating devices have continuously been under active development by those in the field.

Heat per unit area of electronic products is increasingly being increased and can not be effectively dissipated by using a single fan. Thus, several fans are combined to solve the problem of poor heat-dissipating capability of a single fan. Referring to FIG. 1, a cross section of conventional combined two fans is shown, wherein the ribs 12 of the inlet fan 11*a* only function as connecting the frame body 111 and the motor base 17 rather than guiding airflow. Thus, the airflow from the inlet fan 11*a* becomes turbulent when arriving at the outlet fan 11*b*, so that the flow field is unstable. As a result, the outlet fan 11*b* fails to perform normally, the air pressure at the outlet fan 11*b* is reduced, and the combined fans 1 do not perform as expected. Furthermore, due to the unstable flow field, the airflow exiting from the outlet fan 11*b* is not entirely directed to the target heat source. Thus, the combined fans 1 are inefficient. Furthermore, the combined two fans 1 tend to produce noise and vibrations during operation.

BRIEF SUMMARY OF THE INVENTION

To avoid the problems of conventional combined fans, the present invention provides a serial fan module and a frame structure thereof, wherein the problem of unstable flow field of the serial fan module is solved, the entire air pressure and air volume are raised and vortex is reduced, so as to achieve greater heat dissipating efficiency and reduced noise.

An embodiment of the present invention provides a frame structure including a first frame body, a second frame body and a plurality of guide elements. The guide elements are disposed between the first frame body and the second frame body. Each of the guide elements has an axial extended part and an inclined part and the inclined part meets the axial extended part at a camber angle. Each of the inclined part has an inner edge toward the first frame body and each of the axial extended part has an outer edge toward the second frame body.

Another embodiment of the present invention also provides a serial fan module including a first fan, a second fan and a plurality of guide elements. The first fan has a first frame body and a first impeller disposed within the first frame body. The second fan has a second frame body and a second impeller disposed within the second frame body. The guide elements are disposed between the first impeller and the second impeller. The guide elements guide airflow from the first fan to the second fan. Each of the guide elements has an axial extended part and an inclined part and the inclined part meets the axial extended part at a camber angle. Each of the inclined part has an inner edge toward the first impeller and each of the axial extended part has an outer edge toward the second impeller.

For the above-mentioned serial fan module and the frame structure thereof, the camber angle ranges between 20 degrees and 50 degrees. The inclined part has a first height, the axial extended part has a second height, and a ratio of the first height to the second height is between 0.2 and 5. The sum of the first height and the second height exceeds or equals 15 millimeters when the first frame body and/or the second frame body have a height of about 38 mm.

The axial extended part is parallel to an axis of the frame structure or inclines to the axis of the serial fan module, or the axial extended part inclines to the axis of the serial fan module by an angle which is smaller than or equal to 20 degrees. The outer edge of the axial extended part and the inner edge of the inclined part are parallel or not parallel to each other. The outer edge approaches or extends away from the inner edge in a radial direction directed to an axis of the serial fan module.

The inclined part and the axial extended part are integrated as a single piece, and the inclined part is connected to the first frame body. The inclined part and the axial extended part are combined to form the guide element. The inclined part is connected to the first frame body, the axial extended part is connected to the second frame body and the axial extended parts are independent elements. The first fan is connected to the second fan via the guide elements.

The first frame body, the second frame body and the guide elements can be integrated as a single piece. The second frame body has an expanded part at the outlet of the serial fan module. The second frame body further has a plurality of static blades. The airflow guided by the guide elements passes through the static blades to the axial extended part and then exits out of the second frame body from the expanded part, wherein the static blades and the inclined parts are of the same structures.

For the serial fan module, the first impeller includes a plurality of first blades having a first top side and a first bottom side. The first top side inclines to a radial direction of the first fan by a first angle and the first bottom side inclines to the radial direction of the first fan by a second angle. The first angle and the second angle are both between 3 and 45 degrees, and the first angle is greater than, equal to or smaller than the second angle. The first bottom side and the inner edge of the inclined part are parallel or not parallel to each other.

Further, the first fan and the second fan can face the same directions or the first fan and the second fan may be disposed back to back and a motor base of the second fan is connected to the second frame body via the axial extended parts. Rotating directions of the first impeller and the second impeller are different.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

Figure 1:
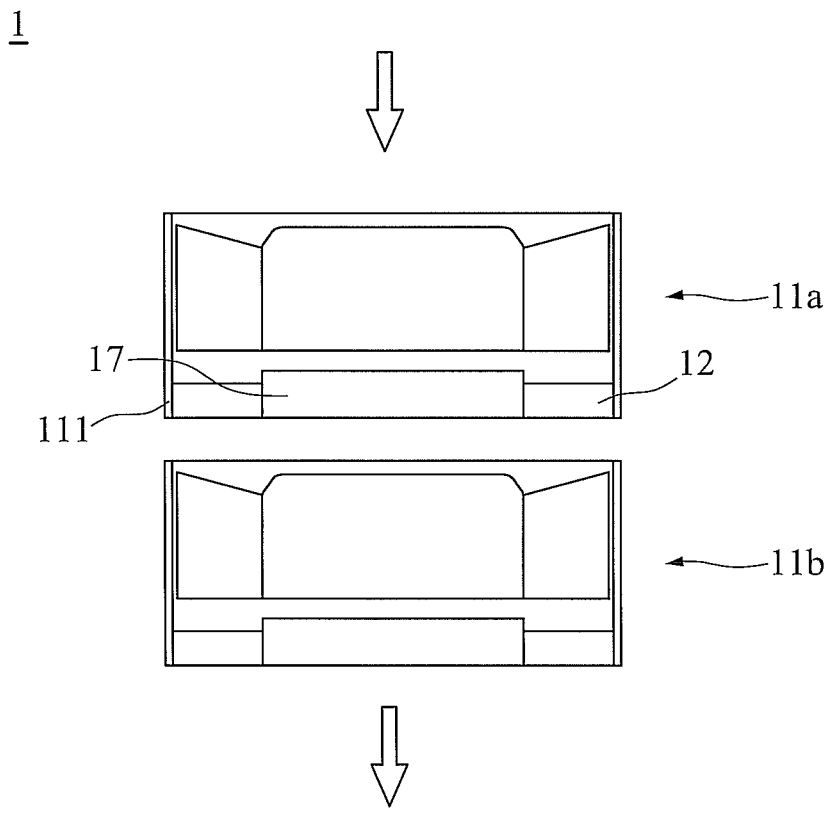
FIG. 1 ( PRIOR ART )
FIG. 1 depicts a cross section of conventional combined two fans.
Figure 2A:
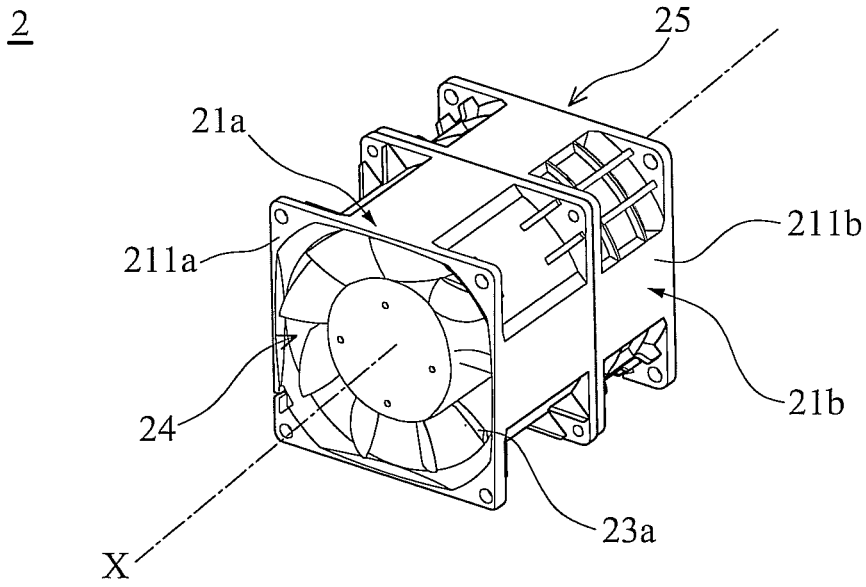
FIGS. 2A and 2B are schematic views of a serial fan module in accordance with an embodiment of the present invention, respectively observed from opposite directions.
Figure 2B:
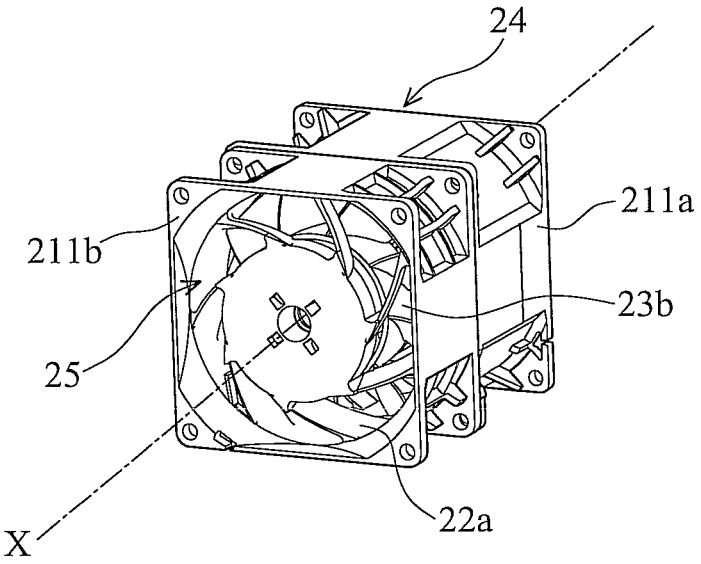
Figure 2C:
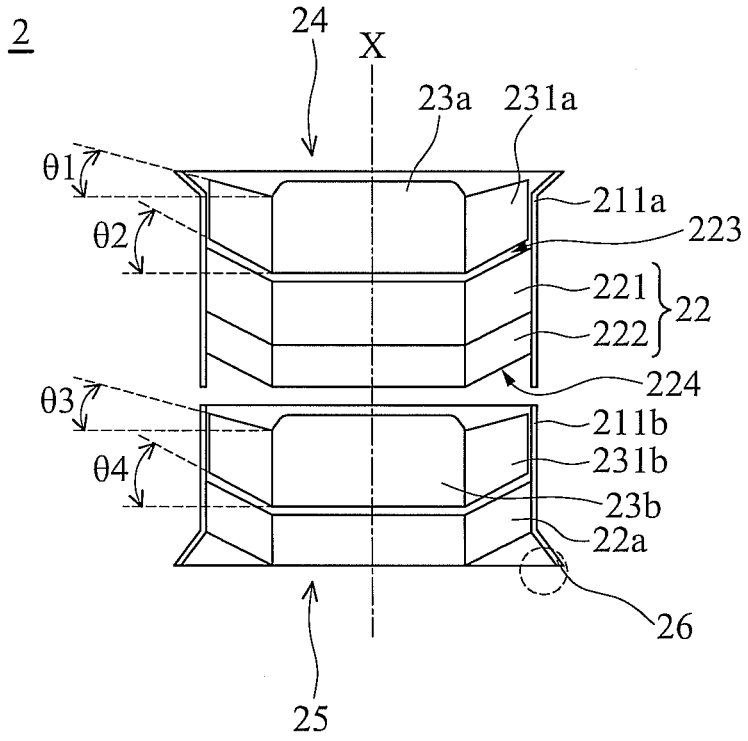
FIG. 2C depicts a cross section of the serial fan module of FIG. 2A.

FIGS. 2A and 2B are schematic views of a serial fan module in accordance with an embodiment of the present invention, and FIG. 2C depicts a cross section of the serial fan module of FIG. 2A. The serial fan module 2 includes a first fan 21*a*, a second fan 21*b*, and a plurality of guide elements 22. The first fan 21*a* has a first frame body 211*a* and a first impeller 23*a*, and the first impeller 23*a* includes a plurality of first blades 231*a*. The second fan 21*b* has a second frame body 211*b* and a second impeller 23*b*, and the second impeller includes a plurality of second blades 231*b*. The guide elements 22 are disposed between the first fan 21*a* and the second fan 21*b*. The guide elements 22 guide airflow from the first fan 21*a* to the second fan 21*b* and the airflow finally leaves the serial fan module 2 from the second fan 21*b*.

Figure 2D:
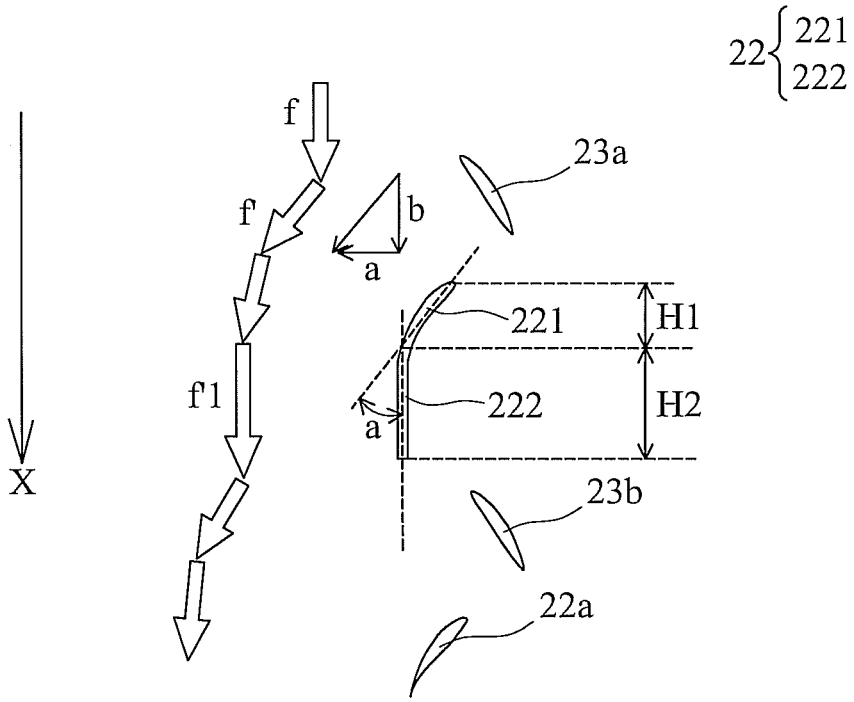
FIG. 2D depicts a cross section of the first fan, the second fan and the guide element of FIG. 2C and the direction of airflow.

Referring to FIG. 2C and FIG. 2D, a cross section of the first fan, the second fan and the guide element of FIG. 2C and the direction of airflow are shown. Each of the guide elements 22 has an inclined part 221 and an axial extended part 222, and the inclined part 221 meets the axial extended part 222 at a camber angle "a" which ranges between 20 degrees and 50 degrees.

When the serial fan module 2 operates, the airflow f enters the first fan 21*a* from the inlet 24 in an approximately vertical direction with respect to the inlet 24. Then, the airflow f is guided by the impeller 23*a* of the first fan 21*a*, and thus, the direction of the airflow is changed as indicated by reference numeral f'. The velocity of the airflow f' includes a tangent velocity component "a" and a vertical velocity component "b", as shown in FIG. 2D.

Because the guide elements 22 are disposed between the first fan 21*a* and the second fan 21*b* of the serial fan module 2. Thus, the airflow f' does not directly enter the second fan 21*b*. Rather, the airflow f' passes through the guide elements 22 before entering the second fan 21*b*. The guiding process of the guide element 22 is described in detail in the following. The inclined angle of the inclined parts 221 is approximately equal to that of the airflow f'. Furthermore, the inclined parts 221 and the axial extended parts 222 constitute a streamlined wing structure. Thus, after passing through each inclined part 221 of the guide element 22, the airflow f' can be smoothly guided to the location where the inclined part 221 and the corresponding axial extended part 222 meet. Meanwhile, the tangent velocity component "a" of the airflow f' is partially converted into the vertical velocity component "b". Then, the airflow f' is guided by the axial extended parts 222 to completely convert the tangent velocity component "a" into the vertical velocity component "b", and exits from the first fan 21*a*. Thus, the airflow f1 meets the inlet of the second fan 21*b* at a right angle when it is guided from the first fan 21*a* to the second fan 21*b*. Therefore, the operation and the power consumption of the second fan 21*b* are similar to those of the first fan 21*a*. Finally, the airflow f1 is guided by the impeller 23*b* of the second fan 21*b* and exits from the airflow outlet 25 of the second fan 21*b* to dissipate heat generated by the heat source, such as CPU.

Referring to FIG. 2C and FIG. 2D, take the serial fan module with two frame bodies whose heights are both about 38 mm as the example, the inclined part 221 has a first height H1, and the axial extended part 222 has a second height H2, then the sum of the first height H1 and the second height H2 preferably exceeds or equals 15 millimeters, and each axial extended part 222 is parallel to an axis x of the serial fan module 2. The present invention, however, is not limited thereto. Additionally, the axial extended part 222 can incline to the axis x of the serial fan module 2 by any angle (not shown) so long as the guiding efficiency of the serial fan module is good. Preferably, the angle is smaller than or equal to 20 degrees.

Each of the inclined part 221 of the guide element 22 has an inner edge 223 toward the first fan 21*a*. Each of the axial extended part 222 of the guide element 22 has an outer edge 224 toward the second fan 21*b*. In this embodiment, the outer edge 224 of the axial extended part 222 and the inner edge 223 of the inclined part 221 are parallel to each other, as shown in FIG. 2C. The present invention, however, is not limited thereto. The inner edge 223 of the inclined part 221 and the outer edge 224 of the axial extended part 222 can be not parallel to each other, wherein the outer edge 224 may approach or extend away from the inner edge 223 in a radial direction directed to an axis of the serial fan module 2.

To be able to utilize the guide element 22 in the serial fan module 2, for example, the first blades 231*a* of the first fan 21*a* and the second blades 231*b* of the second fan 21*b* are inclined upwards. A top side and a bottom side of the first blades 231*a* incline to a radial of the first fan 21*a* by a first angle $\theta_1$ and a second angle $\theta_2$, respectively. A top side and a bottom side of the second blades 231*b* incline to a radial direction of the second fan 21*b* by a third angle $\theta_3$ and a fourth angle $\theta_4$, respectively. The first angle $\theta_1$ is similar to the second angle $\theta_2$, both of which are between 3 and 45 degrees. The third angle $\theta_3$ is similar to the fourth angle $\theta_4$, both of which range between 3 and 45 degrees. Practically, the first angle $\theta_1$ may be greater than, equal to or smaller than the second angle $\theta_2$, and the third angle $\theta_3$ may be greater than, equal to or smaller than the fourth angle $\theta_4$, as shown in FIG. 2C.

When the first blades 231*a* and the second blades 231*b* are combined with the guide element 22, the bottom side of the first blades 231*a* and the inner edge 223 of the inclined part 221 are parallel to each other, and the top side of the second blades 231*b* and the outer edge 224 of the axial extended part 222 are parallel to each other. Thus, the first blades 231*a*, the guide element 22, and the second blades 231*b* all incline upwards and have similar angles to effectively reduce noise of the serial fan module 2.

However, the bottom side of the first fan 21*a* and the inner edge 223 of the inclined part 221 can be not parallel to each other. Similarly, the top side of the second fan 21*b* and the outer edge 224 of the axial extended part 222 can be not parallel to each other.

In practical application, the first fan 21*a*, the second fan 21*b*, and the guide element 22 can be combined in other ways. For purpose of structural simplification, the guide element 22 and the first frame body 211*a* of the first fan 21*a* can be integrated as a single piece. Thus, the serial fan module 2 can be completed through one assembly step and the assembling time can be economized, as shown in FIG. 2C. Similarly, the guide element 22 and the second frame body 211*b* of the second fan 21*b* can be integrated as a single piece to achieve the same effect as the first fan 21*a*.

Figure 3:
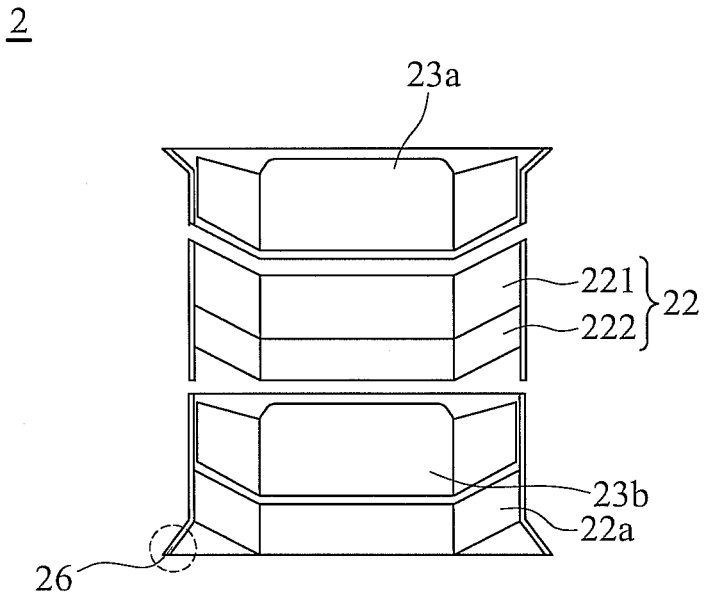
FIG. 3 is a schematic view of another form of the serial fan module in accordance with another embodiment of the present invention.

Referring to FIG. 3, a schematic view of another form of the serial fan module is shown. In the present invention, the guide element 22, the first fan 21*a*, and the second fan 21*b* can be independent, and the inclined part 221 and the axial extended part 222 of the guide element 22 are integrated as a single piece. Thus, regardless of whether rotating directions of the first impeller 23*a* and the second impeller 23*b* are different or the same, the guide elements 22 are always applicable. If the guide elements 22 are damaged, a replacement of the damaged part therefrom will be convenient, thereby increasing the life span of the serial fan module 2.

Figure 4A:
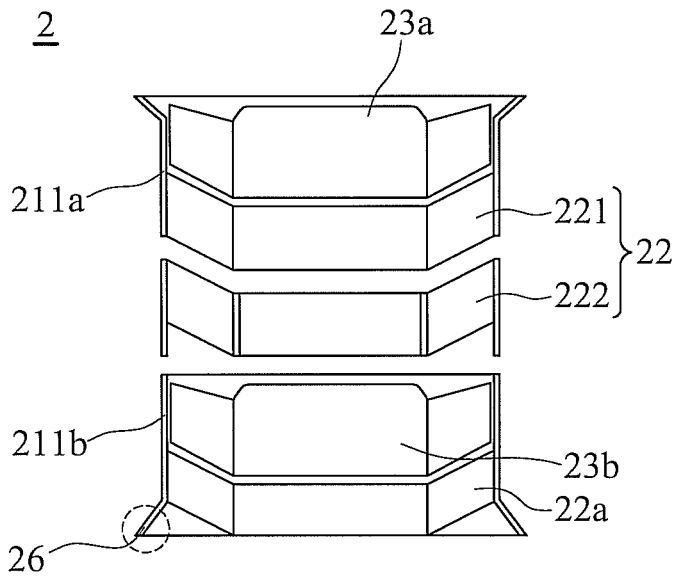
FIGS. 4A and 4B depict other embodiments of the serial fan module containing independent guide elements in accordance with the present invention.
Figure 4B:
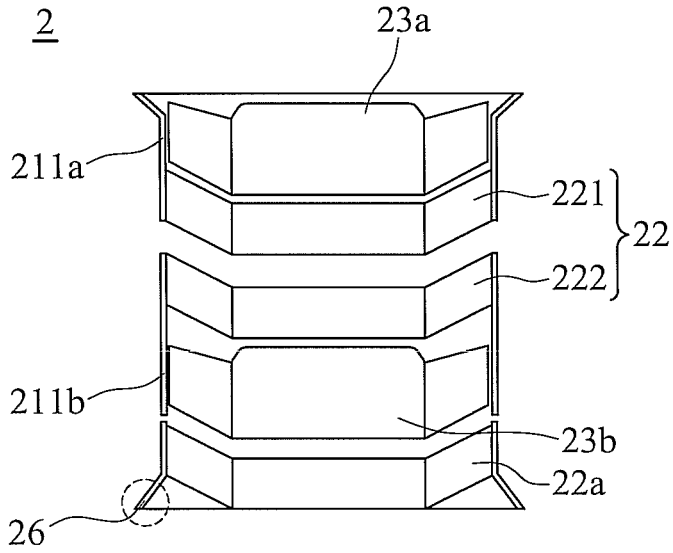

In addition, the guide elements 22 are formed by combining the inclined part 221 and the axial extended part 222. Referring to FIGS. 4A and 4B, two embodiments of the serial fan module formed by independent guide elements in accordance with the present invention are shown. FIG. 4A depicts the first embodiment, wherein the inclined part 221 of the serial fan module 2 are integrally formed with the first frame body 211*a* as a continuous-unified structure, and the axial extended part 222 as an independent element. The serial fan module 2 is formed by assembling the axial extended part 222 and the second frame body 211*b*.

FIG. 4B depicts the second embodiment, wherein the serial fan module 2 is formed by combining the inclined part 221 and the axial extended part 222. The inclined part 221 is integrally formed with the first frame body 211*a* as a continuous-unified structure, and the axial extended part 222 is integrally formed with the second frame body 211*b* as a continuous-unified structure. In both embodiments, the performance of the guide elements is good.

Figure 5:
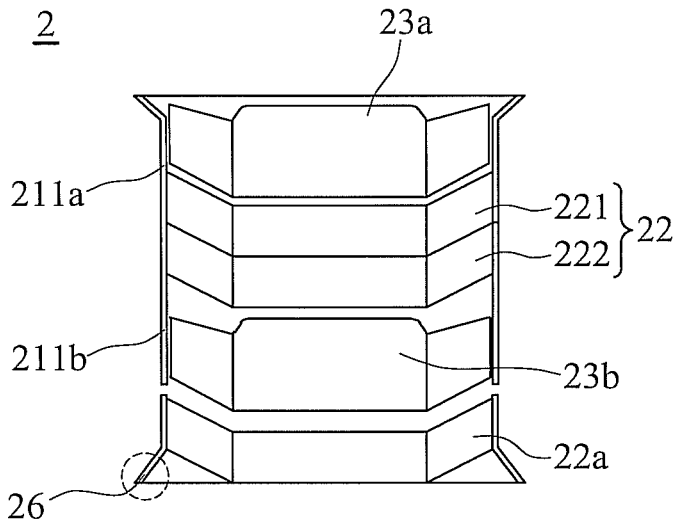
FIG. 5 depicts a cross section of a continuous-unified serial fan module in accordance with another embodiment of the present invention.

Referring to FIG. 5, a cross section of a continuous-unified serial fan in accordance with the present invention is shown. For purposes of structural simplification, the guide elements 22 are integrally formed with the first frame body 211*a* and the second frame body 211*b* as a continuous-unified structure to form the serial fan 2 of the present invention, which achieves the same guiding efficiency as the fans in accordance with the present invention.

In order to guide airflow toward a predetermined direction, a plurality of static blades 22*a* are disposed at airflow outlet 25 of the second fan 21*b* and the static blades 22*a* and the inclined parts 221 are of the same guide structures. Thus, the airflow f can be guided by static blades 22*a* to the area where maximum heat accumulates for achieving heat dissipation. On the other hand, in order to provide large-sized heat-dissipating area, an expanded part 26 can be set at the airflow outlet 25. The airflow f passing through the static blades 22*a* is guided by the expanded part 26 to leave the airflow outlet 25 for achieving heat dissipation, as shown in FIG. 2C, FIG. 3, FIG. 4A, FIG. 4B and FIG. 5. Furthermore, the expanded part 26 can be set at the inlet 24 of the first fan 21*a* to increase the inlet area and the airflow quantity, if necessary.

Figure 6:
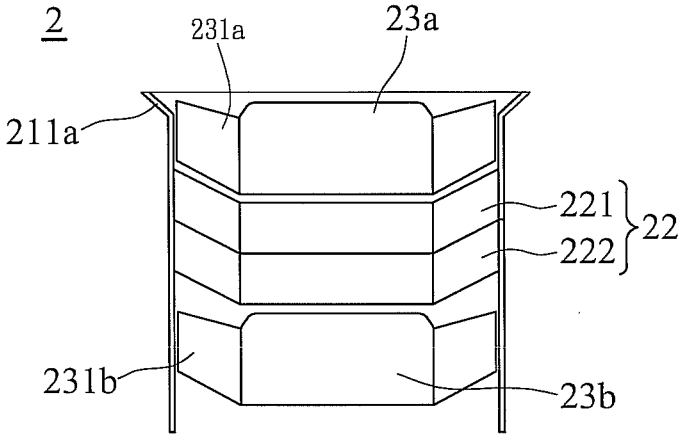
FIG. 6 depicts a serial fan module without static blades at the outlet in accordance with another embodiment of the present invention.

Referring to FIG. 6, the serial fan module without static blades at the outlet in accordance with the present invention is shown. No static blades 22*a* and expanded part 26 are installed at the airflow outlet 25 of the second fan 21*b*. Thus, the installation of the serial fan module is flexible, the noise is reduced, and air quantity produced is increased.

Figure 7A:
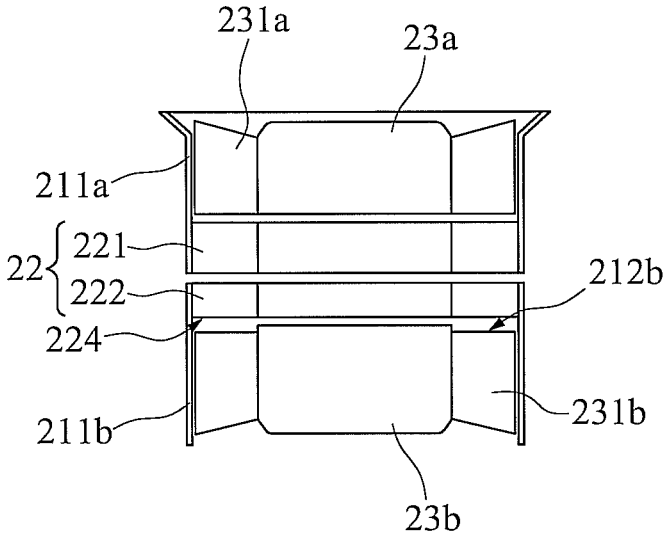
FIGS. 7A to 7C depict various embodiments of the serial fan module with two fans being disposed back to back in accordance with the present invention.
Figure 7B:
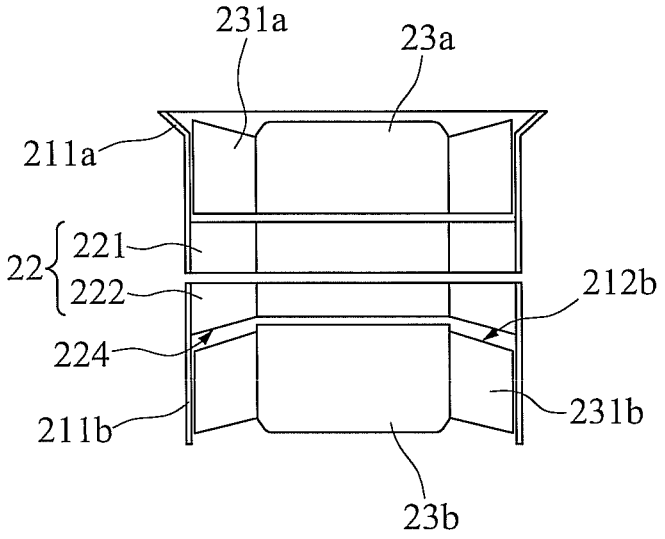
Figure 7C:
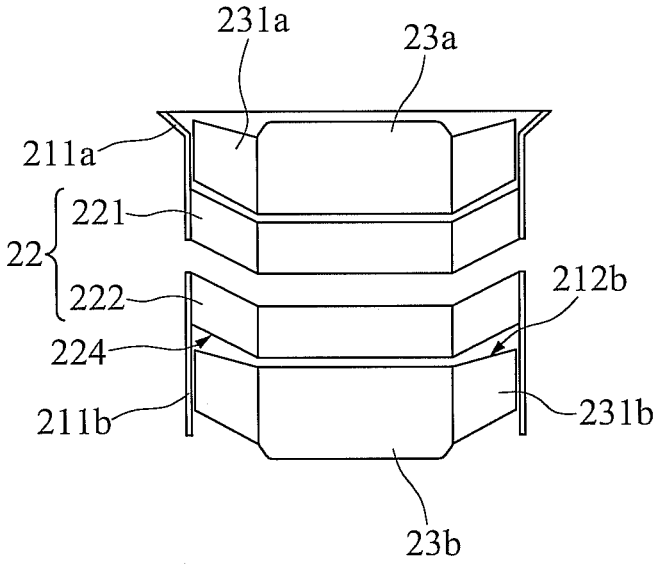

For design of the serial fan module 2, the relational disposition may vary dependent upon requirements. For example, the first fan and the second fan can both face the same directions (in FIGS. 2A, 2B, 2C, 3, 4A, 4B, 5 and 6), or the first fan and the second fan can be disposed back to back. Referring to FIGS. 7A to 7C, various embodiments of the serial fan module with two fans being disposed back to back in accordance with the present invention are shown. In detail, the first fan 21*a* and the second fan 21*b* are disposed back to back. A motor base of the second fan 21*b* is connected to the second frame body 211*b* via the axial extended parts 222 of the guide elements 22. The disposition of the first frame body 211*a*, the second frame body 211*b* and the guide elements 22 is similar to that of the above embodiments, and is not described again.

With regard to the serial fan module 2 with two fans being disposed back to back, the outer edge 224 of the axial extended part 222 can be changed to parallel a second edge 212*b* of the serial fan module 2 to comply with the extension of the second edge 212*b* of the second blades 231*b*, as shown in FIG. 7A and FIG. 7B. Moreover, the second blades 231*b* of the second fan 23*b* can be designed to extend downward. That is, the first blades 231*a* and the second blades 231*b* extend in the same direction. Thus, noise, which is produced in the operation of the serial fan module 2, is suppressed and efficiency of the serial fan module 2 is increased, as shown in FIG. 7C.

Furthermore, multiple first fans 21*a* can be employed to meet practical requirements. The first fans 21*a* are connected to each other by guide elements 22. Then, the assembled first fan 21*a* and the second fan 21*b* are combined to form the serial fan module 2 and achieve great dissipating efficiency for various applications. In addition, the first fan 21*a* and the second fan 21*b* can be the same for convenient replacement.

For the above descriptions, the serial fan module 2 is provided with the guide elements 22 to solve the problem of unstable flow field arising from vortex at the outlet 25, and raises the entire air pressure and air volume, so as to achieve greater heat dissipating efficiency and reduced noise. Furthermore, the first fan 21*a* and the second fan 21*b* are of similar characteristics due to the use of guide elements 22, which is advantageous to design and development of the product. Various ways of assembling the guide elements 22 control noise of the airflow and provide flexibility in production and assembly.

While the present invention has been described by way of example and in terms of preferred embodiment, it is to be understood that the present invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A serial fan module, comprising:

a first fan, comprising a first frame body and a first impeller disposed within the first frame body, wherein the first frame body comprises a first expanded part at an inlet of the serial fan module;

a second fan, comprising a second frame body and a second impeller disposed within the second frame body, wherein the second frame body comprises a second expanded part at an outlet of the serial fan module; and a plurality of guide elements guiding an airflow from the first fan to the second fan and being disposed between the first impeller and the second impeller;

wherein each of the guide elements comprises an axial extended part and an inclined part, the axial extended part is parallel to an axial axis of the serial fan module, and the inclined part meets the axial extended part at a camber angle;

wherein each of the inclined part comprises an inner edge toward the first impeller, and each of the axial extended part comprises an outer edge toward the second impeller;

wherein the inclined part is part of the first frame body and the axial extended part is part of the second frame body;

wherein each of the inclined part and each of the axial extended part respectively comprise an outer side, the entirety of the outer side is parallel to the axial axis;

wherein the first impeller comprises a plurality of first blades having a first top side and a first bottom side, the first top side inclines to a radial direction of the first fan by a first angle, and the first bottom side inclines to the radial direction of the first fan by a second angle, the first angle and the second angle are both between 3 and 45 degrees, and the first angle is either greater than or smaller than the second angle.

2. The serial fan module as claimed in claim 1, wherein the camber angle ranges between 20 degrees and 50 degrees.

3. The serial fan module as claimed in claim 1, wherein the inclined part has a first height, the axial extended part has a second height, and a ratio of the first height to the second height is between 0.2 and 5.

4. The serial fan module as claimed in claim 1, wherein the inclined part has a first height, the axial extended part has a second height, and the sum of the first height and the second height exceeds or equals 15 millimeters when at least one of the first frame body and the second frame body have a height of about 38 mm.

5. The serial fan module as claimed in claim 1, wherein the outer edge of each axial extended part and the inner edge of the corresponding inclined part are parallel to each other, or not parallel to each other.

6. The serial fan module as claimed in claim 5, wherein the outer edge of each axial extended part approaches the inner edge of the corresponding inclined part in a radial direction directed to an axis of the serial fan module.

7. The serial fan module as claimed in claim 5, wherein the outer edge of each axial extended part extends away from the inner edge of the corresponding inclined part in a radial direction directed to an axis of the serial fan module.

8. The serial fan module as claimed in claim 1, wherein the first bottom side and the inner edge of the inclined part are parallel or not parallel to each other.

9. The serial fan module as claimed in claim 1, wherein the inclined part and the axial extended part are combined to form the guide element.

10. The serial fan module as claimed in claim 9, wherein the inclined part is connected to the first frame body as a single piece, and the axial extended part is connected to the second frame body as another single piece.

11. The serial fan module as claimed in claim 9, wherein the inclined part is connected to the first frame body as a single piece, and the axial extended part is an independent element.

12. The serial fan module as claimed in claim 1, wherein the second frame body further comprises a plurality of static blades, and the airflow guided by the guide elements passes through the static blades to the axial extended part and then exits out of the second frame body from the expanded part.

13. The serial fan module as claimed in claim 1, wherein the first fan and the second fan both face the same directions, or the first fan and the second fan are disposed back to back, and rotating directions of the first impeller and the second impeller are different.

14. A frame structure, comprising:

a first frame body comprising a first expanded part at an inlet of the frame structure;

a second frame body comprising a second expanded part at an outlet of the frame structure; and a plurality of guide elements disposed between the first frame body and the second frame body;

wherein each of the guide elements has an axial extended part and an inclined part, the axial extended part is parallel to an axial axis of the frame structure, and the inclined part meets the axial extended part at a camber angle;

wherein each of the inclined part comprises an inner edge toward the first frame body, and each of the axial extended part comprises an outer edge toward the second frame body;

wherein the inclined part is part of the first frame body and the axial extended part is part of the second frame body;

wherein each of the inclined part and each of the axial extended part respectively comprise an outer side, the entirety of the outer side is parallel to the axial axis.

15. A serial fan module, comprising:

a first fan, comprising a first frame body and a first impeller disposed within the first frame body, wherein the first frame body comprises a first expanded part at an inlet of the serial fan module;

a second fan, comprising a second frame body and a second impeller disposed within the second frame body, wherein the second frame body comprises a second expanded part at an outlet of the serial fan module; and a plurality of guide elements guiding an airflow from the first fan to the second fan and being disposed between the first impeller and the second impeller;

wherein each of the guide elements comprises an axial extended part and an inclined part, the axial extended part is parallel to an axial axis of the frame structure, and the inclined part meets the axial extended part at a camber angle;

wherein each of the inclined part has a first height, each of the axial extended part has a second height, and a ratio of the first height to the second height is between 0.2 and 5;

wherein the inclined part is part of the first frame body and the axial extended part is part of the second frame body;

wherein each of the inclined part and each of the axial extended part respectively comprise an outer side, the entirety of the outer side is parallel to the axial axis;

wherein the first impeller comprises a plurality of first blades having a first top side and a first bottom side, the first top side inclines to a radial direction of the first fan by a first angle, and the first bottom side inclines to the radial direction of the first fan by a second angle, the first angle and the second angle are both between 3 and 45 degrees, and the first angle is either greater than or smaller than the second angle.

* * * * *